US006189864B1

(12) United States Patent
Crow et al.

(10) Patent No.: US 6,189,864 B1
(45) Date of Patent: Feb. 20, 2001

(54) SPLINED SHAFT ASSEMBLY FOR CLUTCH SUPPORT APPARATUS

(75) Inventors: Perry A. Crow, Lawson; Tony Allen Shirk, Savannah, both of MO (US)

(73) Assignee: Gray Automotive Products, Inc., St. Joseph, MO (US)

( * ) Notice: Under 35 U.S.C. 154(b), the term of this patent shall be extended for 0 days.

(21) Appl. No.: 09/265,673

(22) Filed: Mar. 10, 1999

(51) Int. Cl.[7] ..... B60P 1/48
(52) U.S. Cl. ..... 254/8 B; 254/134; 254/133 R
(58) Field of Search ..... 269/47–52, 17; 254/8 B, 8 R, 133, 134, 124, DIG. 4

(56) References Cited

U.S. PATENT DOCUMENTS

| | | | |
|---|---|---|---|
| 1,325,962 | 12/1919 | Templeton . | |
| 1,751,480 | 3/1930 | Howell . | |
| 2,421,324 | 5/1947 | Graham . | |
| 2,637,523 | 3/1953 | Lucker . | |
| 2,643,779 | 6/1953 | Hamlin . | |
| 2,747,837 | 5/1956 | Turner . | |
| 2,748,459 | 6/1956 | Orr . | |
| 2,802,635 | 8/1957 | Engelbart . | |
| 2,841,301 | 7/1958 | Sherriff . | |
| 2,879,682 * | 3/1959 | Parker et al. | 279/138 |
| 2,976,033 | 3/1961 | Martin . | |
| 3,087,630 | 4/1963 | Karnow et al. . | |
| 3,109,626 | 11/1963 | Arnes et al. . | |
| 3,136,526 | 6/1964 | Wolf . | |
| 3,218,056 | 11/1965 | Kaplan et al. . | |
| 3,381,953 | 5/1968 | Miller . | |
| 3,383,894 | 5/1968 | Leitner . | |
| 3,479,715 | 11/1969 | Hendrickson . | |
| 3,948,484 | 4/1976 | Tesinsky . | |
| 4,021,017 | 5/1977 | Adams . | |
| 4,118,010 | 10/1978 | Hanscom . | |
| 4,154,470 | 5/1979 | Dalglish . | |
| 4,172,316 | 10/1979 | Rock et al. . | |
| 4,358,143 | 11/1982 | Cullen . | |
| 4,479,632 | 10/1984 | McIntire et al. . | |
| 4,523,888 | 6/1985 | Pezzner et al. . | |
| 4,549,722 | 10/1985 | Gagliano . | |
| 4,564,994 | 1/1986 | Marx . | |
| 4,684,310 | 8/1987 | Stange . | |
| 4,691,904 | 9/1987 | Armstrong . | |
| 4,916,792 | 4/1990 | Haubus . | |
| 5,033,717 | 7/1991 | Symon . | |
| 5,190,265 | 3/1993 | Barry et al. . | |
| 5,251,875 | 10/1993 | Craychee et al. . | |

FOREIGN PATENT DOCUMENTS

| | | |
|---|---|---|
| 382998 | 11/1932 | (GB) . |

* cited by examiner

*Primary Examiner*—Robert C. Watson
(74) *Attorney, Agent, or Firm*—Shook, Hardy & Bacon L.L.P.

(57) ABSTRACT

A splined sleeve assembly is provided for use on a component support apparatus such as a clutch jack or the like. The support apparatus includes a base, a lift arm supported on the base for movement between a lowered position and a raised position, and a piston and cylinder assembly connected between the base and the lift arm for moving the lift arm between the lowered and raised positions. The support apparatus also includes a hinge plate supported on the lift arm for pivotal movement between raised and lowered positions, and the splined sleeve assembly includes a cylindrical support shaft adapted to be mounted on the hinge plate. A tubular sleeve presents a longitudinal axis and includes a cylindrical inner surface sized for axial and rotational sliding receipt on the support shaft, and an outer surface that includes a plurality of longitudinally extending splines adapted to engage a clutch or other component. When the hinge plate is pivoted to the raised position, the longitudinal axis of the support shaft is disposed in a substantially horizontal plane, and when the hinge plate is pivoted to the lowered position, the longitudinal axis of the support shaft is disposed in a substantially vertical plane.

15 Claims, 2 Drawing Sheets

SPLINED SHAFT ASSEMBLY FOR CLUTCH SUPPORT APPARATUS

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally to support devices for clutches and other automotive components, and more specifically to a support apparatus having a splined sleeve assembly adapted to support and align the components of an automotive clutch during repair and placement.

A lifting device for vehicle parts is described in U.S. Pat. No. 5,251,875, to Craychee, and includes a boom that is supported on a wheeled base for pivotal movement about a horizontal axis between raised and lowered positions, a receiver mounted on a distal end of the boom for receiving a clutch attachment or the like, and a hydraulic jack supported on the device between the base and the boom for permitting movement of the boom between the raised and lowered positions. The clutch attachment includes a splined shaft that is rotatingly coupled to a yoke by providing a slip fit between a receiving bore of the yoke and the mating portion of the shaft. This rotational feature of the clutch attachment allows the splined shaft to cooperatively engage the splined portion of a vehicle clutch while the clutch is attached to the vehicle. The shaft is removable from the yoke to permit many different clutch designs to be accommodated by the device by affixing the appropriately designed shaft to the yoke.

A technical problem experienced in the use of the conventional construction resides in the expense of manufacturing a splined shaft out of metal, and of mounting the shaft on the support device in such a way as to permit rotation of the shaft during use. Another technical problem encountered in the use of the conventional construction resides in the necessity of manufacturing a separate splined shaft for each type of clutch or component to be supported on the device, further increasing the cost of making and owning such a device.

BRIEF SUMMARY OF THE INVENTION

It is an object of the present invention to solve the technical problems left unaddressed by the prior art, and to provide a splined sleeve assembly for use on a component jack or the like, wherein the sleeve assembly includes a shaft secured to the support apparatus and a splined sleeve that is removably supported on the shaft for relative rotation to permit the sleeve to cooperatively engage the splined portion of a vehicle clutch while the clutch is attached to the vehicle.

It is another object of the invention to provide a splined sleeve assembly in which the sleeve is removable from the shaft to permit many different clutch designs to be accommodated by the device by simply sliding the appropriately designed sleeve on the shaft, rendering the need for a relatively complex rotatable shaft assembly unnecessary.

In accordance with these and other objects evident from the following description of a preferred embodiment of the invention, a splined sleeve assembly is provided for use on a component support apparatus. The splined sleeve assembly broadly includes a cylindrical support shaft adapted to be mounted on the support apparatus, and a tubular sleeve presenting a longitudinal axis and including a cylindrical inner surface sized for axial and rotational sliding receipt on the support shaft, and an outer surface that includes a plurality of longitudinally extending splines.

By providing a construction in accordance with the present invention, numerous advantages are realized. For example, by providing a splined sleeve separate from the shaft of the assembly, the cost of producing the assembly is reduced relative to conventional constructions, and it is possible to provide several different types and sizes of sleeves for use with a single shaft such that many different clutch designs may be accommodated.

A support apparatus having particular adaptability for use with the splined sleeve assembly of the present invention includes a base, a lift arm supported on the base for movement between a lowered position and a raised position, and a piston and cylinder assembly connected between the base and the lift arm for moving the lift arm between the lowered and raised positions. A hinge plate is supported on the lift arm for pivotal movement about a horizontal axis between a raised position and a lowered position, and the support shaft is mounted on the hinge plate so that when the hinge plate is pivoted to the raised position, the longitudinal axis of the support shaft is disposed in a substantially horizontal plane, and when the hinge plate is pivoted to the lowered position, the longitudinal axis of the support shaft is disposed in a substantially vertical plane.

By providing a support apparatus in accordance with the present invention, it is possible to remove a clutch from a vehicle and then lower it to a height at which it can be removed from beneath the vehicle for repair and/or replacement. As such, it is not necessary to raise the vehicle in order to remove or repair the clutch.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
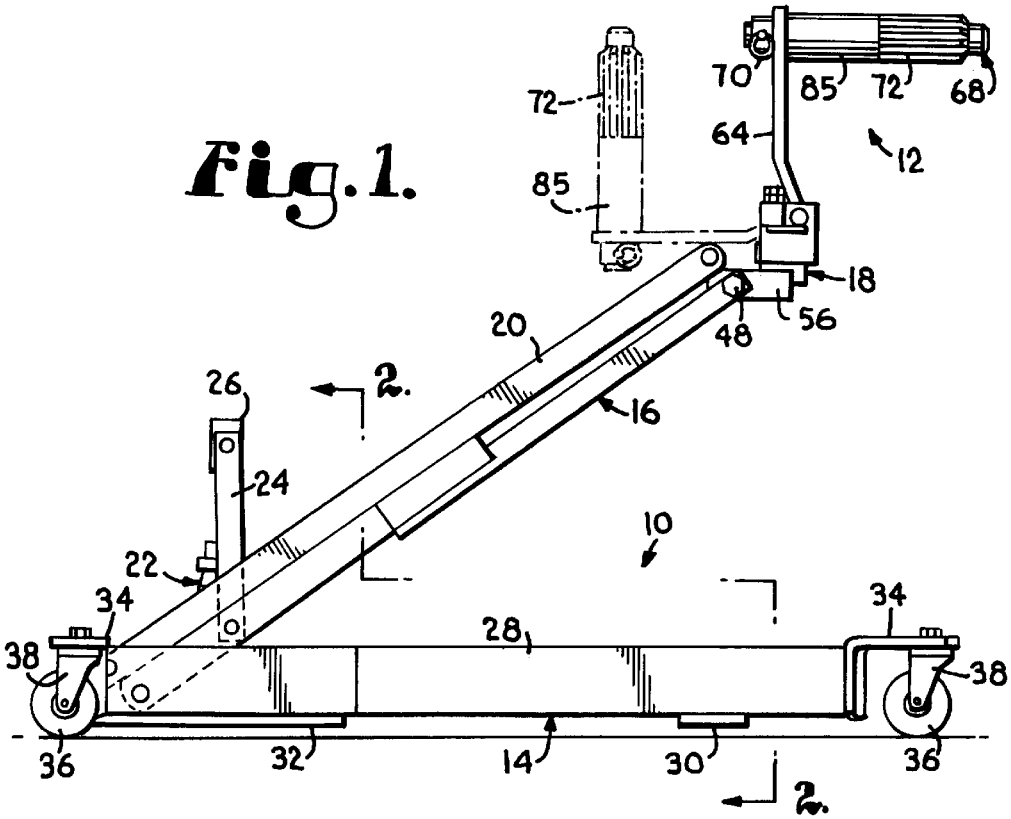
FIG. 1 is a side elevational view of a clutch jack including a splined sleeve assembly constructed in accordance with the preferred embodiment of the present invention, the clutch jack being shown in a raised position.

A clutch jack constructed in accordance with the preferred embodiment of the present invention is illustrated in FIG. 1, and broadly includes a support apparatus 10 and a splined sleeve assembly 12. Although the invention is described with reference to the illustrated jack, it is understood that the invention is equally applicable to other conventional types of support apparatuses, such as with stationary work stands, benches or platforms, and may be used in such environments without departing from the scope of the invention set forth in the claims.

Figure 2:
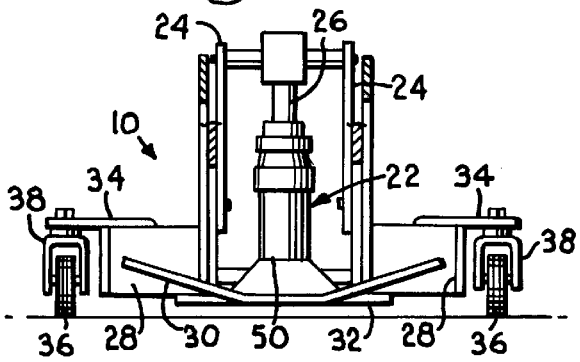
FIG. 2 is a sectional view of the jack taken along line 2—2 of FIG. 1.

The support apparatus 10 in the illustrated embodiment broadly includes a base 14 and a lift arm 16 supported on the base for pivotal movement between relatively raised and lowered positions. A receiver 18 is linked to the free end of the lift arm for supporting the splined sleeve assembly, and a pair of leveling links 20 are pivotally connected at each end thereof to the base and the receiver for maintaining the level orientation of the receiver during movement of the lift arm. As shown in FIG. 2, a piston-and-cylinder assembly 22 is supported between the base and the lift arm for moving the lift arm between the raised and lowered positions, and a pair of drag links 24 are connected between a piston 26 of the assembly and the lift arm 16 for transmitting lifting and lowering movement of the piston to the lift arm.

Figure 4:
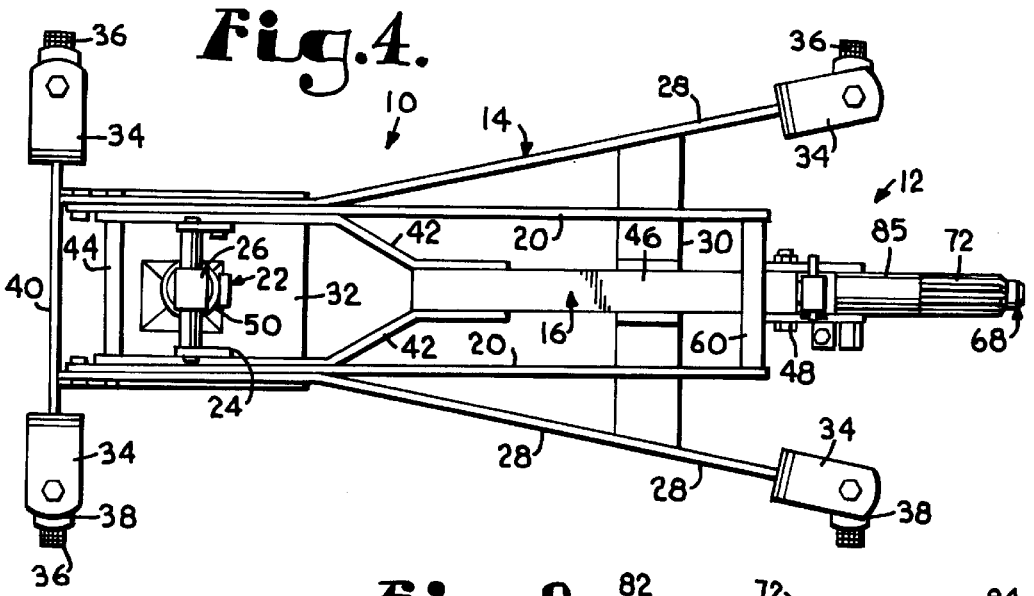
FIG. 4 is a top plan view of the jack in the lowered position.

As shown in FIG. 4, the base 14 of the support apparatus is formed by a pair of laterally spaced rails 28 that extend generally longitudinally of the jack, a transverse cross member 30 connected between the rails intermediate the ends thereof, and a plate 32 welded or otherwise affixed to the bottoms of the rails adjacent the opposite end of the base. The rails are spaced laterally from one another by a distance sufficient to receive the lift arm and leveling links of the jack therebetween in the lowered position of the lift arm so that the profile presented by the jack is as low as possible in the lowered position.

A mounting bracket 34 is secured to the end of each rail 28 for supporting a caster wheel 36 and swivel 38. At the opposite end of the base, an end wall 40 is welded to the ends of the rails, and a mounting bracket 34 is secured to each end of the wall for supporting a caster wheel 36 and swivel 38. As such, the apparatus is supported on the four casters for universal two-directional movement on the floor or ground.

The lift arm 16 includes a pair of elongated, laterally spaced lift arm links 42 presenting opposed first and second ends, wherein the first ends are supported on the base by a pin 44 for pivoting movement relative to the base 14 and the second ends are secured to a lift arm bar 46 that forms a part of the lift arm. The lift arm links 42 are preferably formed from flat bar stock that is bent intermediate the ends to provide a larger spacing between the links adjacent the first ends than at the second ends in order to accommodate the jack 22 between the links. The lift arm bar 46 is preferably formed of either solid or tubular bar stock, and presents a first end welded or otherwise affixed to the second ends of the lift arm links 42, and a second end presenting a transverse aperture through which a pin 48 is received.

Figure 3:
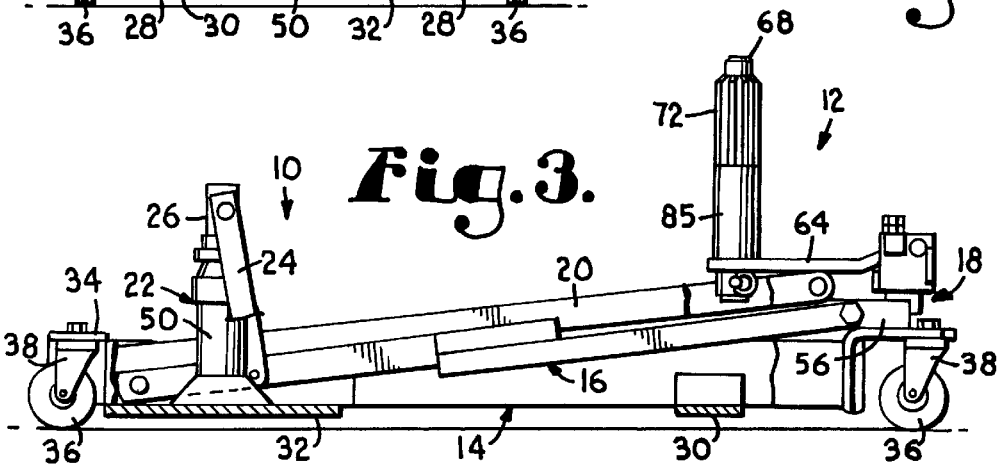
FIG. 3 is a side elevational view of the jack in a lowered position.

As shown in FIG. 3, the jack 22 rests on the plate 32 of the base 14, and includes a body 50 defining a cylinder, and the piston 26 received in the cylinder for relative movement between extended and retracted positions. In the illustrated embodiment, the jack 22 is a conventional bottle jack. However, any other type of jack could be employed so long as it presents a pair of relatively shiftable ends that can be connected to the base and the lift arm of the apparatus to shift the lift arm between the raised and lowered positions. Likewise, the jack could be oriented for extension and retraction in a vertical direction, as shown, or in a horizontal or other direction. So long as the jack permits raising and lowering of the lift arm, the construction and orientation of the jack may take any desired form.

With reference to FIG. 1, the drag links 24 are connected between the piston 22 of the jack and the lift arm links 42 of the lift arm, and function to transmit the lifting force of the jack to the lift arm. Each drag link is supported at one end for pivotal movement on the piston and at the opposite end for pivotal movement on one of the lift arm links.

The jack includes a handle socket sized for receipt of a conventional handle that can be repeatedly actuated to operate the jack, and a release valve that can be adjusted through the use of a flex shaft assembly to permit descent control and down stop control of the jack. The piston 26 presents a free end protruding from the body, and a pair of pins protrude horizontally from the free end to receive the drag links 24. As such, extension and retraction of the piston is transmitted to the lift arm 16 by the drag links.

Figure 5:
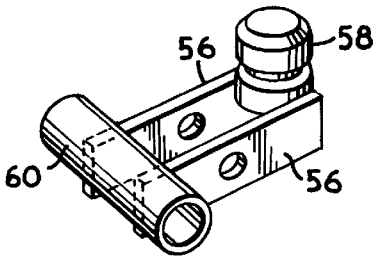
FIG. 5 is a perspective view of a receiver forming a part of the clutch jack.

As shown in FIG. 5, the receiver 18 is defined by a pair of laterally spaced bars 56 and a centrally disposed post 58 welded or otherwise secured between the bars adjacent one end thereof In addition, the receiver includes a transverse tube or sleeve 60 that is welded or otherwise affixed to the opposite ends of the bars on the top sides thereof, and that defines a point of attachment between the receiver and the leveling links. A pair of collinear, transverse holes are formed in the links at a point intermediate the ends thereof, and define a point of attachment between the receiver and the lift arm. As shown in FIG. 1, the pin 48 secures the receiver in place on the free end of the lift arm, and is received in the holes for permitting pivotal movement of the receiver on the lift arm during raising and lowering of the arm. The leveling links 20 are also secured to the receiver by a pin extending through the sleeve, and permit relative pivoting movement of the receiver such that a four bar linkage is defined by the receiver 18, the lift arm 16, the base 14 of the jack, and the leveling links 20. This linkage retains the receiver in a horizontal plane during raising and lowering of the lift arm.

Figure 6:
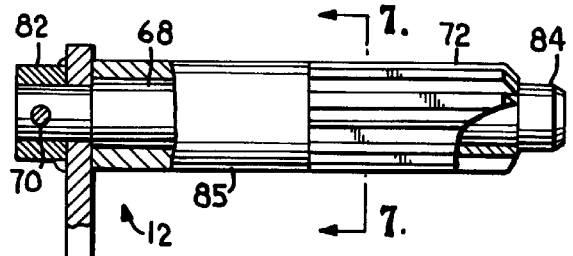
FIG. 6 is a side elevational view of the splined sleeve assembly.

The splined sleeve assembly 12 is shown in FIG. 6, and broadly includes a swivel bracket 62 adapted to be supported on the post of the receiver, a hinge plate 64 supported on the swivel bracket by a pin 66 for pivotal movement about the axis of the pin, a shaft 68 secured to the hinge plate by a suitable fastener 70, and a splined sleeve 72 received on the shaft.

Figure 9:
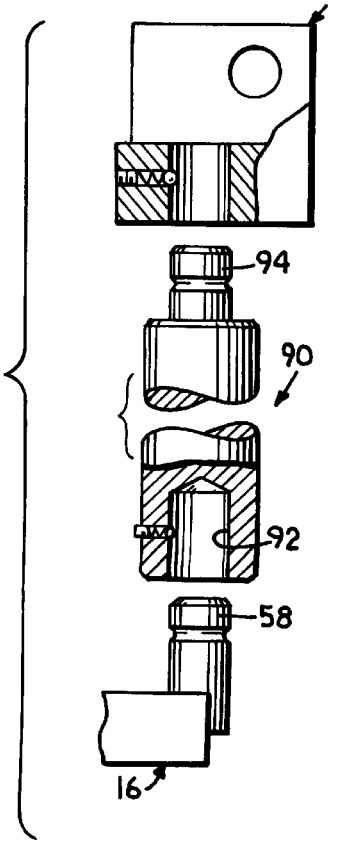
FIG. 9 is an exploded side elevational view of an extension element forming a part of the apparatus.

The swivel bracket 62 includes a bottom block and a pair of upstanding side walls. The bottom block includes a central vertical aperture sized for receipt on the post of the receiver and a fastener is provided for securing the swivel on the post so that the swivel can rotate about the longitudinal axis of the post as shown in FIG. 9. Preferably, as shown in FIG. 5, the post 58 includes an annular groove around the circumference thereof, and the fastener is a clip or spring biased detent that engages the groove to retain the swivel in place on the post while permitting relative pivotal movement therebetween. A spring biased detent is preferred because it provides ease of removal of the post. Returning to FIG. 6, the side walls of the swivel bracket 62 present a pair of collinear holes sized for receipt of the pin 66 to support the hinge plate for relative pivotal movement about the axis of the pin.

Preferably, the pin 66 protrudes slightly beyond one of the side walls, and a small plate 76 is welded or otherwise attached to the pin to define a stop plate. A small, laterally projecting post 78 is secured to the same side wall from which the pin projects, and is disposed in the path of travel of the stop plate 76 so that the range of pivoting movement of the hinge plate toward a vertical orientation is limited by engagement between the stop plate and the post. If desired, a threaded transverse hole can be formed in the post in an orientation generally tangential to the direction of movement of the stop plate, and a screw 80 can be threaded into the hole to define an adjustable stop against which the stop plate strikes to limit further pivotal movement of the hinge plate relative to the swivel bracket. This feature provides the operator with adjustment to level the splined sleeve to match the mating component of the vehicle.

The hinge plate 64 presents a free end in which a hole is formed, and an annular collar 82 is welded or otherwise affixed to the plate in alignment with the hole. The collar includes a transverse hole sized for receipt of the fastener 70. The shaft 68 is preferably formed from a solid rod of steel or other suitable material, and includes a proximal end presenting a reduced diameter sized for receipt in the hole in the hinge plate. A transverse hole is formed in the small diameter region of the shaft, and is sized and positioned to align with the hole in the collar, and to receive the fastener 70 to hold the shaft against the hinge plate and secure it in place against rotation or any other type of movement relative to the plate. As such, the shaft 68 and hinge plate 64 move as a unitary element when the shaft is secured in place, and no relative rotation or other movement is permitted therebetween. The opposite or distal end of the shaft 68 is preferably provided with an enlarged stepped segment 84 that presents an outer diameter larger than the outer diameter of the remainder of the shaft. The stepped segment 84 also presents an outer end having a tapered circumferential edge which facilitates insertion of the shaft into a clutch or other component to be supported on the apparatus. Preferably, the stepped segment 84 is permanently affixed to the shaft. However, it may be threaded onto the end of the shaft, if desired, in order to facilitate replacement of the sleeve on the shaft without requiring removal of the shaft from the hinge plate.

Figure 7:
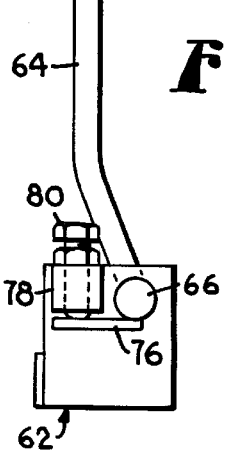
FIG. 7 is a sectional view taken along line 7—7 of FIG. 6.
Figure 7:
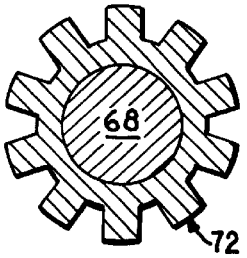

The sleeve 72 is formed of any suitable material, e.g. metal, a ceramic material, a synthetic resin material or the like and, as shown in FIG. 7, presents an inner surface having a diameter that is slightly larger than the outer diameter of the shaft, and an outer surface that includes a plurality of longitudinally extending splines corresponding in size, orientation and shape to the splines of a clutch or other component to be supported on the apparatus. Preferably, as shown in FIG. 6, the distal end of the sleeve includes a tapered circumferential edge to facilitate insertion of the sleeve into a component to be supported thereon.

Figure 8:
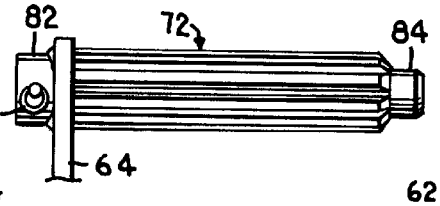
FIG. 8 is a fragmentary view of the splined sleeve assembly, illustrating an alternate embodiment thereof.

The sleeve 72 may be formed by machining, molding, metal cold forming, pultrusion or extrusion techniques, or by any other conventional technique for forming such elements. If desired, the sleeve can be made of a length less than the distance defined between the hinge plate and the stepped segment 84 of the shaft, and a second sleeve 85 can be provided as a spacer to hold the splined sleeve against or adjacent to the distal end of the shaft. The spacer includes an inner diameter that is slightly larger than the outer diameter of the shaft, and an outer cylindrical surface having a diameter substantially equal to or less than the diameter of the splined sleeve. Alternately, as shown in FIG. 8, the splined sleeve 72 can be constructed of a length corresponding to the distance between the hinge plate and the stepped segment of the shaft.

Because the inner surface of the sleeve 72 is slightly oversized relative to the diameter of the shaft 68, the sleeve is permitted to rotate on the shaft about the longitudinal axis thereof, and permits the splines on the outer surface of the sleeve to be rotated to any desired orientation so that the sleeve assembly can be aligned with a clutch or other component during use. With reference to FIG. 1, once the sleeve is so aligned with the component, as shown in solid lines, the jack is moved toward the component so that the sleeve 72 and shaft 68 engage the component. Thereafter, it is possible to move the component onto the sleeve assembly, lower the lift arm, and pivot the hinge plate 64 to the lowered position, shown by broken lines in FIG. 1, in which the component is retained on the sleeve assembly during further manipulation of the apparatus.

With the component pivoted to the lowered position of the hinge plate, and the lift arm in the lowered position, the apparatus can be rolled from beneath the vehicle and repaired. Once such repair is completed, the apparatus is rolled back beneath the vehicle, the hinge plate is pivoted to the raised position, and the lift arm is raised to position the component adjacent its proper position on the vehicle so that it can be slid axially from the sleeve back into its proper position on the vehicle.

By employing the apparatus of the present invention, it is not necessary to lift the component to or from the jack in order to remove it from the vehicle or replace it upon completion of repairs. In addition, alignment of the sleeve assembly with the component is simplified by the provision of the rotatable sleeve, and insertion of the sleeve assembly into the component is facilitated by the tapered distal ends of the shaft and sleeve.

As illustrated in FIG. 9, an extension element 90 can be provided in order to extend the vertical reach of the apparatus so that a clutch or other component can be raised to and lowered from a greater height than would otherwise be possible. For example, although the apparatus has a vertical capability sufficient to enable its use on a conventional truck, the extension element is required in order to enable use of the jack apparatus with a truck that has been lifted, or with a fertilizer truck or other vehicle having a greater ground clearance than conventional trucks.

The extension element broadly includes a solid or tubular cylindrical column presenting a lower end having a receptacle sized for receipt on the pin 58 of the receiver, and an upper end presenting a pin 94 substantially identical to the pin 58. A suitable fastener is provided for securing the extension element on the post 58 so that the extension element is retained in position during use of the apparatus. Although rotation of the extension element is not required, it is possible to provide a fastener that permits such rotation about the pin 58, if desired.

During use of the apparatus, if it is determined that the extension is required, the splined sleeve assembly is removed from the pin of the receiver, and the extension 90 is positioned on the pin 58 so that the pin is received in the recess 92. Thereafter, the splined sleeve assembly 12 is positioned on the pin 94 of the extension element in the same manner as it is normally received on the pin 58 of the receiver. Thereafter, operation of the jack apparatus is identical to the operation described above. The only difference in operation is that the overall height of the jack apparatus is increased by a distance equal to the height of the body portion of the extension element 90.

Returning to FIG. 6, if it is necessary to replace the sleeve on the assembly, e.g. because of wear to the sleeve or in order to permit a different component to be supported on the apparatus, the fastener 70 is removed, allowing the shaft 68 to be pulled from the hinge plate 64. Thereafter, the sleeve 72 can be slid from the proximal end of the shaft and a new sleeve returned to its place. By permitting such substitution of the sleeve, different sizes and shapes of sleeves can be employed with the assembly without departing from the scope of the invention. For example, although the sleeve is illustrated as a splined sleeve, a sleeve presenting square-shaped outer surface, or any other shape, may be substituted therefor. As such, although the invention has been described with reference to the preferred embodiment illustrated in the attached drawing, it is noted that substitutions may be made and equivalents employed herein without departing from the scope of the invention as recited in the claims.

In the claims:

1. A splined sleeve assembly for use on a component support apparatus, the splined sleeve assembly comprising:

a cylindrical support shaft adapted to be mounted on the support apparatus; and a tubular sleeve presenting a longitudinal axis and including a cylindrical inner surface sized for axial and rotational sliding receipt on the support shaft wherein the sleeve is removable from the shaft by axial movement therefrom, and an outer surface that includes a plurality of longitudinally extending splines wherein the sleeve is adapted to be removably mounted to the support shaft.

2. The splined sleeve assembly as recited in claim 1, wherein the tubular sleeve is made from a metal.

3. The splined sleeve assembly as recited in claim 1, wherein the cylindrical support shaft is made from synthetic resin metal.

4. The splined sleeve assembly as recited in claim 1, wherein the tubular sleeve includes a distal end that is tapered.

5. The splined sleeve assembly as recited in claim 1, wherein the cylindrical support shaft is adapted to be removably mounted on the support apparatus.

6. A support apparatus for use with the splined sleeve assembly as recited in claim 1, the support apparatus comprising:

a base, a lift arm supported on the base for movement between a lowered position and a raised position;

a piston and cylinder assembly connected between the base and the lift arm for moving the lift arm between the lowered and raised positions; and a hinge plate supported on the lift arm for pivotal movement about a horizontal axis between a raised position and a lowered position, the support shaft being mounted on the hinge plate so that when the hinge plate is pivoted to the raised position, the longitudinal axis of the support shaft is disposed in a substantially horizontal plane, and when the hinge plate is pivoted to the lowered position, the longitudinal axis of the support shaft is disposed in a substantially vertical plane.

7. The support apparatus as recited in claim 6, wherein the base includes a plurality of wheels on which the apparatus is supported for rolling movement.

8. The support apparatus as recited in claim 6, wherein the lift arm is supported on the base for pivotal movement about a horizontal axis between the lowered and raised positions.

9. The support apparatus as recited in claim 6, wherein the hinge plate includes a hole in which the support shaft is received, the splined sleeve assembly further comprising a fastener for securing the support shaft in the hole against movement relative to the hinge plate.

10. The support apparatus as recited in claim 6, further comprising an extension element supported on the lift arm, wherein the hinge plate is supported on the extension element for pivotal movement about the horizontal axis between the raised and lowered positions.

11. A component support apparatus, the component support apparatus comprising:

a splined sleeve assembly, wherein the splined sleeve assembly includes a base, a lift arm supported on the base for movement between a lowered position and a raised position, a piston and cylinder assembly connected between the base and the lift arm for moving the lift arm between the lowered and raised positions, and a hinge plate supported on the lift arm for pivotal movement about a horizontal axis between a raised position and a lowered position, the support shaft being mounted on the hinge plate so that when the hinge plate is pivoted to the raised position, the longitudinal axis of the support shaft is disposed in a substantially horizontal plane, and when the hinge plate is pivoted to the lowered position, the longitudinal axis of the support shaft is disposed in a substantially vertical plane; and a support assembly, wherein the support assembly includes a cylindrical support shaft adapted to be mounted on the support apparatus, and a tubular sleeve presenting a longitudinal axis and including a cylindrical inner surface sized for axial and rotational sliding receipt on the support shaft, and an outer surface that includes a plurality of longitudinally extending splines.

12. The component support apparatus as recited in claim 11, wherein the base includes a plurality of wheels on which the apparatus is supported for rolling movement.

13. The component support apparatus as recited in claim 11, wherein the lift arm is supported on the base for pivotal movement about a horizontal axis between the lowered and raised positions.

14. The component support apparatus as recited in claim 11, wherein the hinge plate includes a hole in which the support shaft is received, the splined sleeve assembly further comprising a fastener for securing the support shaft in the hole against movement relative to the hinge plate.

15. The component support apparatus as recited in claim 11, further comprising an extension element supported on the lift arm, wherein the hinge plate is supported on the extension element for pivotal movement about the horizontal axis between the raised and lowered positions.

* * * * *